United States Patent [19]

Mercer et al.

[11] Patent Number: 4,993,550

[45] Date of Patent: Feb. 19, 1991

[54] PACKING SMALL MESH PIECES

[75] Inventors: Frank B. Mercer, Blackburn; Brian Orr, Preston; Keith F. Martin, Blackburn, all of Great Britain

[73] Assignee: Nelton Limited, Blackburn, Great Britain

[21] Appl. No.: 304,614

[22] Filed: Feb. 1, 1989

[30] Foreign Application Priority Data

Nov. 3, 1988 [GB] United Kingdom ..... 8825773

[51] Int. Cl.[5] ..... B65D 85/46

[52] U.S. Cl. ..... 206/321; 206/390; 206/412

[58] Field of Search ..... 206/390, 321, 389, 408, 206/410, 412, 417

[56] References Cited

U.S. PATENT DOCUMENTS

| | | | |
|---|---|---|---|
| 3,835,992 | 9/1974 | Adams, IV | 206/390 |
| 4,023,706 | 5/1977 | Dearlove . | |
| 4,279,341 | 7/1981 | Pleickhardt | 206/390 |

FOREIGN PATENT DOCUMENTS

| | | |
|---|---|---|
| 0147528 | 8/1984 | European Pat. Off. . |
| 7313775 | 4/1975 | Netherlands . |
| 2106872 | 4/1983 | United Kingdom . |
| 2120475 | 12/1983 | United Kingdom . |
| 2135660 | 2/1984 | United Kingdom . |
| 2126188 | 3/1984 | United Kingdom . |
| 2140785 | 5/1984 | United Kingdom . |

OTHER PUBLICATIONS

Hadley, D. A., "Static—Friend or Foe?", Converting Today-Trade & Technical Feature, four (4) page article.

*Primary Examiner*—Joseph Man-Fu Moy

*Attorney, Agent, or Firm*—Fleit, Jacobson, Cohn, Price, Holman & Stern

[57] ABSTRACT

In order to provide a suitable packaging system, mesh pieces are deposited across the width of a moving run of flexible wrapping material and are deposited in longitudinally overlapping relationship along the length of the wrapping material, by feeding the mesh pieces on a belt which moves more quickly than the wrapping material; the mesh pieces are ejected from the end of the belt onto the wrapping material. The direction of movement of the wrapping material is inclined downwards so that the trailing ends of the mesh pieces contact the wrapping material before the leading ends contact the preceding mesh piece. The wrapping material, with the mesh pieces on it, is then rolled up under tension into a spiral bale so that the overlapping edges curl down and prevent the mesh pieces slipping out.

5 Claims, 4 Drawing Sheets

PACKING SMALL MESH PIECES

BACKGROUND OF THE INVENTION

GB-A-2 120 475 describes a way of strengthening a particulate matrix in which relatively small, light weight, generally flat pieces of flexible, open plastics mesh structure are randomly embedded in the matrix. GB-A-2 120 475 can be referred to for details. Such pieces each weigh less than 5 g, and have a weight of less than 80 g/m$^2$ or more particularly less than 50 g/m$^2$.

The normal way of embedding the mesh pieces in the matrix is to mix them together. The supply of the mesh pieces to the point of mixing has given significant problems. In GB-A-2 120 475, it is suggested that a continuous length of mesh can be cut up into the pieces immediately before mixing, but in practice, this is not convenient. End-users wish to buy the mesh pieces already cut. This requires that the mesh pieces should be packaged so that they occupy a relatively small space, and the mesh pieces must be flat and relatively easy to disentangle from each other.

The high flexural recovery of the mesh pieces makes them very difficult to package in a dense form. Attempts have been made to stack the pieces and then ram them so that they can be wrapped with film in a compact bale.

It was not found possible to stack the mesh pieces without creasing, and the mesh pieces became very tightly interlocked after compression and were difficult to separate by the end user.

The size and weight of each individual mesh piece is so small that it is very easily moved by vibration, air flow, static electricity or contact with moving parts, so that there are immense difficulties in providing any ordered arrangement. Furthermore, because the mesh pieces are flat and severed from the same sheet of mesh material, they are very close to each other, and a minimum of movement of any mesh piece will cause interlocking with its neighbour and a chain reaction with other mesh pieces. If this happens, it is nearly impossible to handle the mesh pieces. Because of the way in which the mesh pieces are slit, each piece will have protruding strands around its edges, which easily engage the protruding strands of the next mesh piece, or indeed lock into the meshes of the next mesh piece.

THE INVENTION

The present invention provides methods as set forth in claims 1, 24, 27 or 28, packages as set forth in claims 17 or 25 and machines as set forth in claims 22 or 26. The remaining claims set forth optional features of the invention.

The invention can overcome all the problems noted above in a very simple manner. The mesh pieces can be laid properly on the wrapping material and firmly secured by the opposed sheet of wrapping material. The package, particularly if it is rolled up, is very easy to use as the flat overlapping form in which the mesh pieces are maintained mainly eliminates interlocking, and as the package is opened, the mesh pieces readily fall and separate from the wrapping material. The package is suitable for continuous feeding to a mixing machine since the mesh pieces can be easily discharged from the wrapping material, e.g. in the mixing chamber of the machine. The mesh pieces can be relatively static-free in the package.

By moving or bending towards the axis of the package, the edge portions of the wrapping material effectively narrow down or close the gaps at the edges, between adjacent turns of wrapping material, and provide retention of the mesh pieces along the edges of the package, i.e. stop the mesh pieces falling out of the edges. Preferably, the edges of substantially every turn overlap the edge portions of the preceding turn, as seen looking at the side of the package; the respective edge portions can engage, but as some cockling may occur, the engagement may be intermittent.

The package can be made to any suitable size or weight, for ease of handling. The package can have a density similar to that achieved by conventional baling.

Normally, the wrapping material will be rolled up on a circular core, so that the package is generally circular, but this is not essential—an oblong packet may be formed by rolling onto a rectangular section core, in which case the 'axis' is not so exactly defined but will exist.

PREFERRED EMBODIMENTS

The invention will be further described, by way of example, with reference to the accompanying drawings, in which.

FIG. 1

Figure 1:
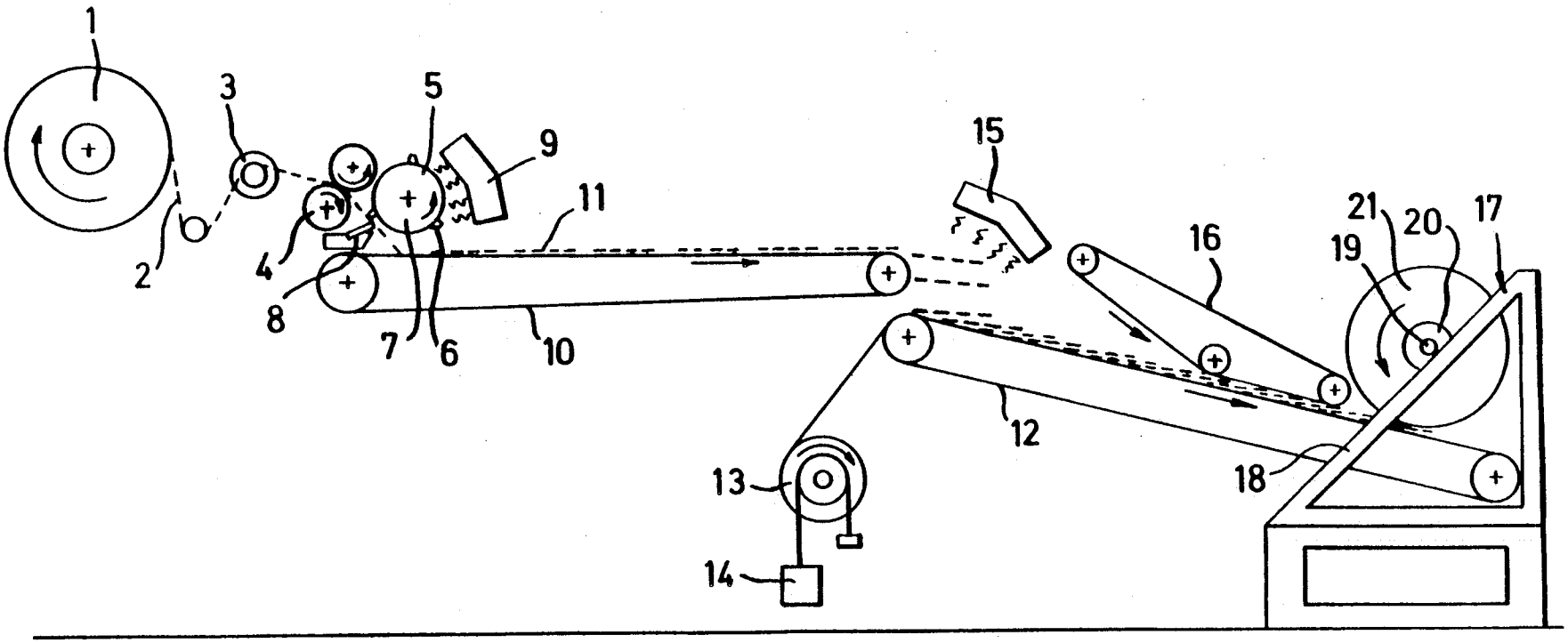
FIG. 1 is a schematic side view of a packaging machine in accordance with the invention.

There is a feed reel 1 of substantial size, being a continuous length of mesh structure as described in GB-A-2 120 475. The mesh 2 is fed to a series of rotary side-by-side slitting blades 3 on a rotating shaft, for slitting the mesh 2 into tapes (multiple widths each equal to the pitch of the slitting blades 3)

The mesh 2 is pulled through the slitting blades 3 by a pair of feed nip rolls 4 which feed the slit tapes into a rotary cross-cutting unit 5. The unit 5 has a number of cross-cutting blades 6 mounted on a cylinder 7 which rotates about a transverse axis. Each blade 6 co-acts as a shear with a static transverse blade 8. The blades 6 cut the whole width of each tape simultaneously, i.e. the blades 6 have a minimum of transverse angle; if there were not simultaneous cutting, the pieces, after cutting the last strand, would flick sideways and interlock with their neighbours. There is a static eliminator 9 which keeps the air surrounding the cross-cutting zone below a static electrical potential of 500 V.

Beneath the cross-cutting unit 5, there is a take-off conveyor belt 10, which is electrically conductive in order to further reduce by earthing any static electricity retained in the mesh pieces 11. The linear velocity of the take-off conveyor belt 10 is greater than the linear velocity of the tapes immediately before being cut, as determined by the rolls 4—the increase in speed is between 30% and 50%. This spaces the pieces 11 apart in the direction of travel. In addition, the take-off conveyor belt 10 is positioned so that the leading end of each mesh piece 11 contacts the take-off conveyer belt 10 before the mesh piece 11 is cut off from the tape; this ensures maintenance of the alignment of the mesh pieces 11 after cross-cutting.

The same conveyor belt 10 acts as a supply conveyor whose downstream end is positioned above the upstream end of a slower conveyor belt 12 which has a high friction rubber surface; the preferred degree of overlap of the pieces 11 on the belt 12 is from 50% to 95%, and the conveyor speeds are regulated accordingly—it is possible to operate with an overlap of less than 50%, but the arrangement is less economic. The take-off belt 12 preferably travels at 2% to 50% of the linear feed speed of the rolls 4. A roll 13 of stretch wrap film (wrapping material) 13 is positioned so that the film is carried along the belt 12, and there is a tension brake 14 so that the film 13 is under tension (which is within the elastic limit of the film 13) sufficient to stretch the film by 5 to 15%, say 10%; the film 13 acts as the wrapping material and the pieces 11 are deposited on to the film 13. However, the film 13 is sufficiently wide for its edges to extend beyond those pieces 11 which are nearest the edges. The pieces 11 will be projected off the end of the supply conveyor belt 10, but tip slightly forwards as their trailing ends continue to be supported when their leading ends 4 are free. However, the belt 12 is inclined downwards relative to the direction of travel of the pieces 11 at the end of the supply conveyor belt 10, and the trailing edge portion of each piece 11 engages the film 13 before the engagement of the leading edge portion of the piece 11 with the preceding piece 11—in theory, it would be possible for the leading and trailing ends to engage simultaneously, but this is difficult to achieve in practice. In this way, the falling piece 11 is much less likely to disturb the preceding piece 11. The closest vertical distance between the supply belt 10 and the take-off belt 12 should be no more than 120 mm to 200 mm, and preferably no more than 140 mm, between the belt surfaces. The pieces 11 must fall into the correct position since further movement on the belt 12 is not possible due to the projecting filament ends. The supply belt 10 is preferably horizontal and the take-off belt 12 is preferably inclined at 15° to 30° to the horizontal.

A static eliminator 15 (like the eliminator 9) is provided in the deposition zone, to keep a very low level of static electricity and maintain a flat fall of the pieces 11 from the belt 10 to the belt 12.

In this manner, the pieces 11 will be distributed across the width of the film 13 and also longitudinally of the film 13, each piece 11 overlapping the preceding piece and being overlapped by the succeeding piece. The amount of overlap depends upon the relative speeds, but can be from 50% up to 98%, for instance.

While supported by the belt 12, the pieces 11 on the film 13 are flattened and compressed by a moving member in the form of a further belt 16 which is smooth surfaced and travels at a velocity 30%–80% greater than that of the belt 12 and engages the top surfaces of the pieces 11. As can be seen from FIG. 1, the belts 16, 12 slowly approach each other, then travel parallel to one another. The angle between the belts 12, 16 enables a slow compression to take place whilst the difference in speed ensures that all the pieces 11 are lying flat without creasing; once the pieces 11 are lying flat, the belt 16 in general just slips over the tops of the pieces 11. The approach angle between the belts 12, 16 is preferably between 10° and 20° with an entry gap between the belts 12, 16 of 120 mm to 200 mm, say 140 mm.

Immediately after leaving the nip between the belts 12, 16, the pieces 12 are taken into control by a winding arrangement 17. The winding arrangement 17 comprises an inclined winding rack 18 which carries a winder 19 in such a way that a core 20, for instance of cardboard, is closely adjacent to the end of the belt 16 when winding begins, and moves up the rack 17 as winding proceeds. During winding, the stretch wrap film 13 is drawn off the braked roll, assisted by the belt 12, which is also driven. The tension applied to the film 13 is within its elastic limit. The mesh pieces 11 are covered by the preceeding turn and are interleaved and trapped by the spiral of film 13, to form a spiral package or bale 21. As a result of the tension imparted by the brake 14, the film 13 grips the mesh pieces 11 tightly and maintains a dense package. Also, the projecting edges 22 (see FIG. 3) of the film 13 relax and curl over, i.e. move or bend towards the axis of the package 21, causing the edge of one turn to overlap and engage the edge portion 22 of the next preceeding turn to provide a closure which prevents the pieces 11 slipping out sideways, i.e. provides retention of the mesh pieces 11 along the edges of the package 21. The turns of the film 13 separate the individual layers of the package 21.

In an alternative procedure, which can be used even if the film 13 is not substantially extensible, the film 13 is heat shrinkable and, after rolling up into the package 21, the edges are heated (e.g. using hot air), causing the projecting edges 22 to shrink and curl over, i.e. bend towards the axis of the package 21, again providing a closure as described above.

FIGS. 2 AND 3

Figure 2:
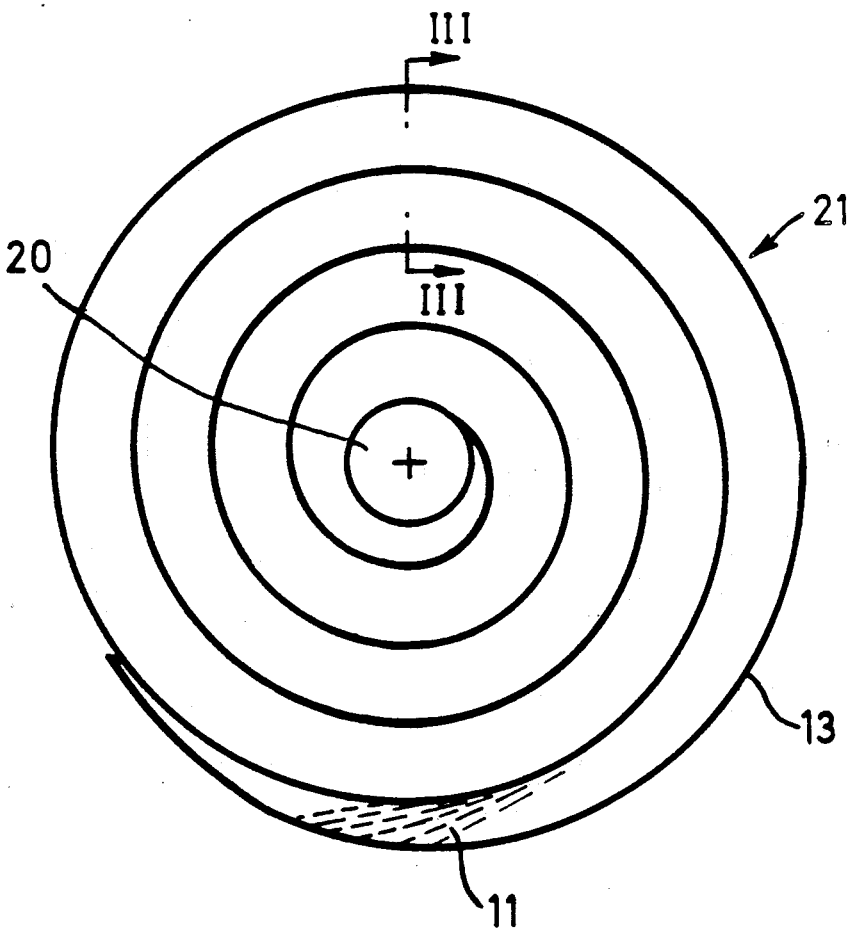
FIG. 2 is a schematic side view of a spiral package or bale formed in accordance with the invention.
Figure 3:
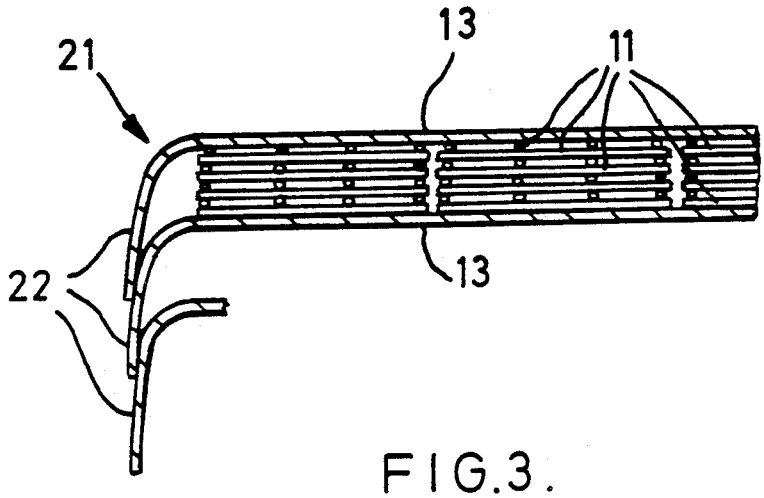
FIG. 3 is a part section, on a larger scale, along the line III—III in FIG. 2.

FIGS. 2 and 3 illustrate the completed package or bale 21.

FIG. 4

Figure 4:
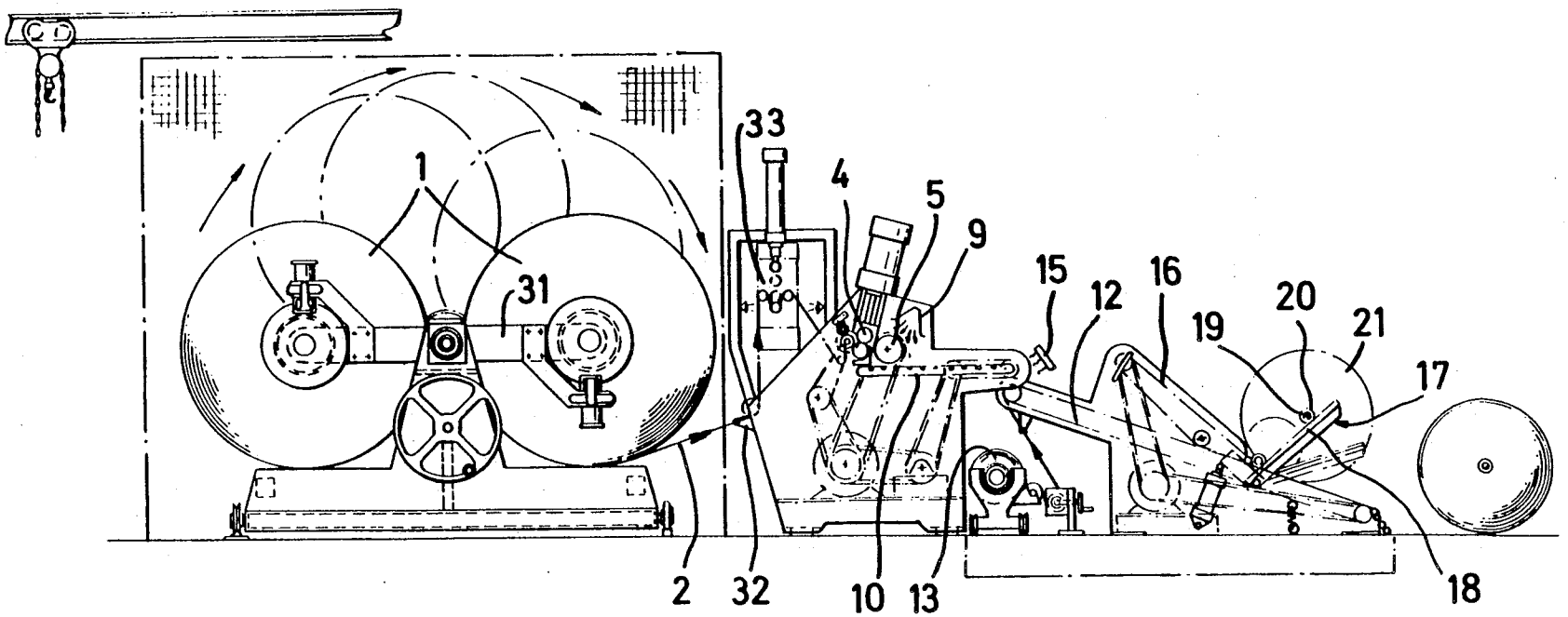
FIG. 4 is a side view of a machine of the invention, constructed on the principles illustrated in FIG. 1.

Using the same reference numerals as for FIG. 1, FIG. 4 illustrates a detailed arrangement. A feed reel 1 is arranged on a swing-over beam 31 for convenient substitution of the next reel 1. A reel run-out sensor 32 is provided as well as a tension system 33 with an edge guide. The static eliminators 9, 15 blow ionised air.

EXAMPLE

As one specific example, the mesh pieces 11 were generally as in GB-A-2 120 475. Details were as follows:

| | |
|---|---|
| Unit weight of mesh pieces 11 | 40 gms/m$^2$ |
| Width of input mesh (feed reel 1) | 600 mm |
| Pitch of strands | 10 mm × 10 mm |
| Length of pieces 11 | 100 mm |
| Width of pieces 11 | 50 mm |
| Wrapping film 13 | linear low density polyethylene |
| Unit weight of film | 22 gms/m$^2$ |
| Axial stretch of film | 6% |
| Overlap of pieces | 30% |
| Finished bale weight | 20 Kg (nett) |

FIG. 5

Figure 5:
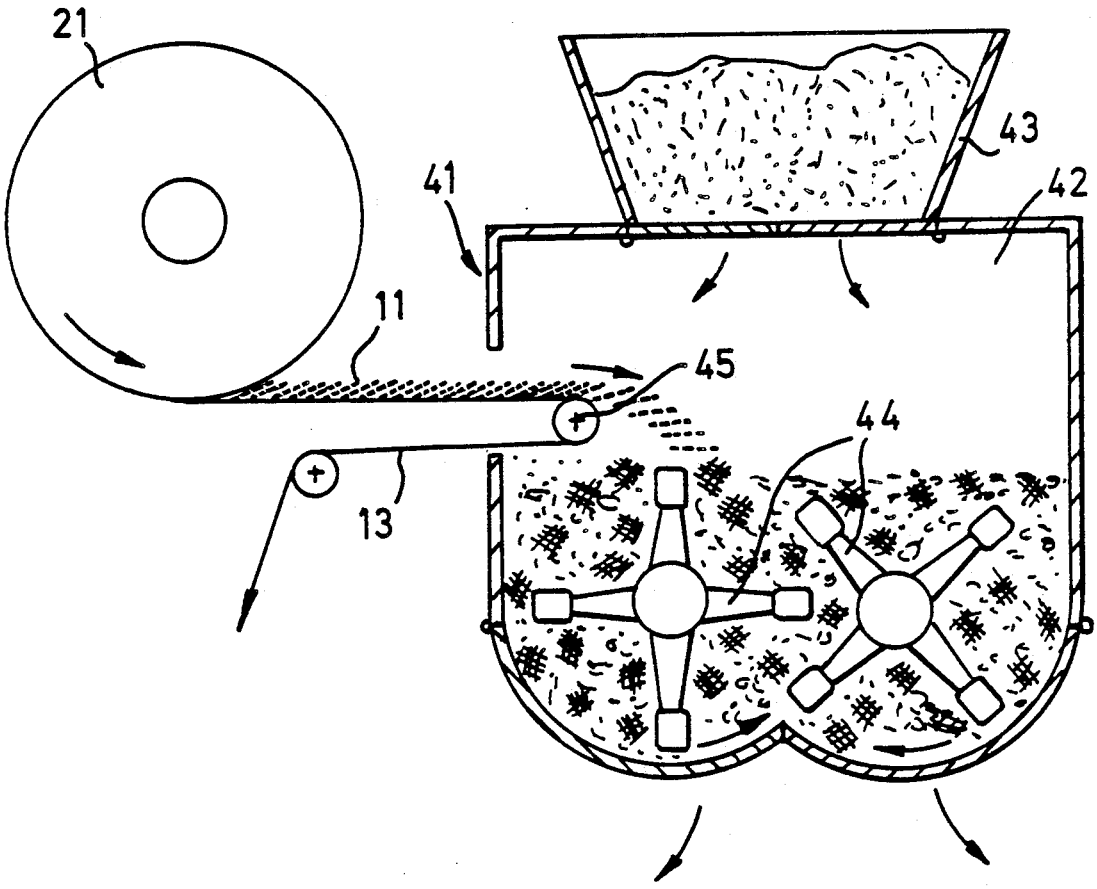
FIG. 5 is a schematic side view of a mixing machine.

FIG. 5 shows a mixing machine or mixer 41 for mixing sand or other soil with the mesh pieces 11 in order to use the mesh pieces 11 as described in GB-A-2 120 475. There is a conventional mixing chamber 42 with a hopper 43 for the sand and counter-rotating mixing blades 44. On one side of the mixing chamber 41, there is an opening provided with a guide roller 45. In order to feed the mesh pieces 11 into the mixing chamber 42, the package 21 is opened and the leading end of the film 13 is taken around the guide roller 45, as shown and attached to a suitable winding drum (not shown). The mesh pieces 11 are then projected off the film 13 into the mixing chamber 42. This manner, the film 13 acts as a carrier or feed conveyor to transport the mesh pieces 13 into the mixer 41.

The present invention has been described above purely by way of example, and modifications can be made within the spirit of the inventions. The invention also consists in any individual features described herein or any combination of such features or any generalisation of such features or combination. For instance, instead of the edges of the wrapping material extending beyond those mesh pieces which are nearest the edges, another form of edge closure or retention could be used. As another instance, the invention could be used for packing any suitable mesh pieces.

We claim:

1. A package of multiplicity of small, light weight mesh pieces having high flexural recovery, which are to be used for strengthening a matrix, the package comprising:

a length of flexible wrapping material which is wide enough to receive a number of the mesh pieces distributed across its width, the wrapping material being rolled up in a generally spiral configuration; and successive, substantially flat, substantially uncreased mesh pieces retained between successive turns of the wrapping material and distributed both across the width of the wrapping material and longitudinally of the wrapping material, substantially each mesh piece longitudinally overlapping another mesh piece and being longitudinally overlapped by a further mesh piece, the edge portions of the wrapping material extending beyond those pieces which are nearest the edges, and the edge portions of substantially every turn of the wrapping material being bent towards the axis of the package and providing retention of the mesh pieces along the edges of the package.

2. The package of claim 1, wherein the wrapping material has been rolled up under tension and extended, the edge portions of the wrapping material thereby being bent towards the axis of the package.

3. The package of claim 1, wherein the wrapping material is heat shrinkable and the edge portions of the wrapping material have been heat shrunk to bend them towards the axis of the package.

4. The package of claim 1, wherein, as seen looking at the side of the package, the edges of substantially every turn of the wrapping material overlap the edge portions of the preceding turn.

5. The package of claim 4, wherein the edge portions of substantially every turn of the wrapping material engage the edge portions of the preceding turn.

* * * * *